United States Patent [19]

Silinsky et al.

[11] 4,424,902

[45] Jan. 10, 1984

[54] METHOD AND APPARATUS FOR PACKING GLASS SHEETS IN A CONTAINER

[75] Inventors: Anatoly A. Silinsky; Vitaly S. Schukin; Evgeny V. Paushkin, all of Moscow, U.S.S.R.

[73] Assignee: Proektno-konstruktorskaya Organizatsiya "Orgsteklo", Gorkobskaya, U.S.S.R.

[21] Appl. No.: 359,314

[22] Filed: Mar. 18, 1982

[51] Int. Cl.[3] ..... B65D 85/48; B65D 81/10

[52] U.S. Cl. ..... 206/454; 206/451; 206/591; 108/102

[58] Field of Search ..... 206/448–455, 206/471, 585, 521, 591, 583; 248/548, 549, 567–570, 589, 595, 636; 267/1.5, 70; 108/106, 108, 110, 102

[56] References Cited

U.S. PATENT DOCUMENTS

| | | | |
|---|---|---|---|
| 3,067,869 | 12/1962 | Denton | 206/523 |
| 3,308,941 | 3/1967 | Keau, Sr. et al. | 206/453 |
| 3,339,722 | 9/1967 | van Antwerpen | 206/453 |
| 3,653,707 | 4/1972 | Pile et al. | 206/477 |
| 3,938,660 | 2/1976 | Moehring | 206/451 |
| 3,963,122 | 6/1976 | Pater et al. | 206/448 |
| 4,320,836 | 3/1982 | Brown et al. | 206/451 |

FOREIGN PATENT DOCUMENTS

| | | | |
|---|---|---|---|
| 253424 | 4/1967 | Austria | 206/452 |
| 2816616 | 10/1979 | Fed. Rep. of Germany | 248/570 |

*Primary Examiner*—Steven M. Pollard
*Assistant Examiner*—Bryon Gehman
*Attorney, Agent, or Firm*—Lilling & Greenspan

[57] ABSTRACT

The distinguishing feature of the method is that a glass stack is formed in a space between container straps, and the glass stack is restrained by positively expanding the elastic straps by means of individual expanding systems which are provided between straps and guides, with concurrent pressing of a stack in the direction parallel with its plane.

An apparatus for carrying out the method comprises a casing, upper and lower guides secured thereto which are installed in a mirror reflecting position and have elastic straps, and individual systems for expanding the elastic straps which are made in the form of two rows of similar members dispersed with respect to the straps and axially shift.

The upper row of the members is rigidly coupled to said straps and the lower row is disposed freely on the guides. Another apparatus for carrying out the method comprises individual systems for expanding the elastic straps which are made in the form of pivotally interconnected links having upper and lower pivots. The upper pivots are coupled by means of brackets to abutments which are secured to the elastic straps and the lower pivots have rollers which are supported by the guides for movement therealong.

7 Claims, 7 Drawing Figures

METHOD AND APPARATUS FOR PACKING GLASS SHEETS IN A CONTAINER

BACKGROUND OF THE INVENTION

The invention relates to the field of packing, transportation and storage of products and materials such as flat and bent sheets which are particularly subjected to damages caused by shocks, shaking and other mechanical actions; and, it may be used in the glass-making industry for the delivery of glass for delivery and also for interplant transportations, as well as for glass transfer inside factories using glass for industrial processing, e.g. at furniture and mirror-making factories.

The invention may also be used for packing and transportation of other products which require safety of surfaces such as polished wooden panels, plastic sheets, and sheets of materials provided with a high-quality plastic coating and also other types of products which are capable of withstanding a certain longitudinal load applied to the end faces.

More specifically, the invention relates to the methods of placing glass sheets into a container, and in particular for packing glass sheets in a container for the purposes of package and transportation, and also to the equipment for these purposes, e.g. to the design of containers for glass or other brittle materials which are subjected to destruction or damage due to even the slightest mechanical actions.

In view of the development of new, highly-productive manufacturing methods in the glass-making industry and further improvement of conventional techniques of glass-making, and also in view of the ever-growing demand for glass in the construction industry, the scale of operations associated with packing, transporting and storing glass has been substantially enlarged.

Glass sheets are generally stored in a vertical position in large packs at storage facilities and in shops at glass-making factories. It is not unfrequent that the glass surface is damaged, especially if there is broken glass in the pack. To avoid damage to the glass, paper cardboard strips, cords, and similar spacers are provided between glass sheets. Glass sheets are separated by means of removable spacers placed on top or laterally of the stack only, and use is also made of specially comb-shaped members providing an air space between individual sheets of glass. For the transportation of glass, containers are generally used in which stacks of glass sheets separated by spacers are placed. The danger of damage to the glass is usually maximum during the handling and transportation operations, and certain technical difficulties also arise in using mechanical equipment for glass packing so that large waste of glass occurs in performing such operations, large quantities of packing materials are spent, and a considerable labour effort is required.

All these factors resulted in the demand for new methods for glass packing. There are a number of methods and apparatus for packing glass which are largely used.

DESCRIPTION OF THE PRIOR ART

Thus, known in the art is a method for packing glass using paper as the spacer material. During packing into a container each glass sheet is wrapped in paper, thereby preventing individual sheets from contacting each other during their subsequent transportation. The paper may also be impregnated with a special composition depending on the transportation conditions, e.g. with paraffin.

The disadvantage of this method is that the use of a great quantity of a spacer material, such as paper, makes the glass transportation very expensive. Generally the size of a paper spacer is only slightly smaller than the glass sheet size so that the consumption of the spacer material increases with an increase in the size of the transported glass sheets. In addition, the use of paper as a spacer does not necessarily eliminates glass losses since complete wear of the spacer may occur during transportation under the action of continuously effective mechanical actions owing to friction forces, as well as rubbing and scratching caused by the friction between the glass and spacer or between adjacent glass sheets after the spacer has been completely worn out.

Known in the art is another method for packing glass, such as bent car glass, which places the glass sheets, installs strip-shaped spacers of an elastic material therebetween, and restrains the glass in this position.

This method also cannot prevent friction forces from developing between the glass and spacer, although the consumption of the spacer material is reduced owing to a smaller surface area of the spacer. Rub portions and scratches appear on the glass surface under the action of friction forces so that some glass sheets have to be rejected. While transporting the stack of glass sheets separated by spacers according to this method, some spacers can fall out from the spaces between the glass sheets thus causing destruction of glass sheets which may result in the damage to the whole glass stack.

Known in the art is an insert for packing bent glass into a pack, consisting of a base and sockets defined by pivotally interconnected plates which are installed between retainers of which one retainer comprises a lug and the other is made in the form of a flat box-shaped member of a width which is at least equal to the maximum curvature of glass.

The glass sheets being packed are inserted one after another with their ends into the sockets formed by the pivotally interconnected plates and then they are restrained by means of the two retainers so as to form a stack having a certain rigidity which depends on the rigidity of the retainers.

This method is deficient in that it cannot be used for packing and transportation of flat glass products so that the field of application of the method is limited. In addition, though the concept involving the use of special sockets for receiving glass edges can enable preservation of glass during transportation, the cost-effectiveness of transportation is nevertheless lowered since rather large spaces are to be left between individual sheets, and the insert design does not makes it possible to reduce these spaces. The most serious disadvantage of this prior art method is an unreliable restraint of the glass stack by the box-shaped member, so that the stack may be displaced during transportation up to the engagement with the container walls which, in the majority of cases, ends up in breakage of glass or rejection of individual sheets. It is this disadvantage that was the reason for limited application of the above-described method for packing glass in the glass-making industry.

During recent years the search for more efficient ways of glass packing was aimed at solving a complex of problems, associated with optimum and efficient arrangement of glass in the container, further reduction of consumption of spacer materials and improvement of the reliability of glass restraint. One of the new methods is a method for restraining glass in a container which involves placing glass into the container, placing removable elastic spacers on the glass edges, and compressing the stack for restraining it, the stack being first compressed by applying force to the glass edges and then in the direction at right angles with the glass plane.

An apparatus for carrying out this method comprises a framing, a support frame formed by horizontal and vertical bars, and removable spacers made of an elastic material, one of the horizontal bars being pivotally fixed and the other provided with sockets to receive glass edges.

After being installed into the sockets which in this case form means for separating glass sheets, the glass is first restrained at the top by means of the removable spacers and then by means of the horizontal bars which effect deformation of the stack in two directions. Owing to the provision of the sockets and spacers air spaces are formed between individual glass sheets which prevent the glass sheets from contacting one another.

This method and apparatus exhibit a certain reliability of glass restraint in use; however, this is only true for small-size car glass pieces. With an increase in the glass size the reliability of restraint by this method decreases since, owing to the heavy weight of large-dimension glass pieces, they are capable of a certain degree of mobility during transportation which becomes more pronounced owing to the use of a large number of spacers which are subjected to both compression and tension in the direction opposite to the compression. It generally results in causing the slipping of the spacers away from the glass edges, thus causing damage to the transported material. Moreover, owing to a low efficiency of restraining the glass stack by means of the bars, the slippage of spacers away from the glass edges occurred also in transporting small-size car glass pieces. The previous method reduces the consumption of a spacer materials owing to a small area of the removable spacers, which are re-used at that, but this consumption is, nevertheless, considerable and in view of an ever-growing increase in the amount of transportation it has a steady trend towards growth. The abovedescribed method and apparatus cannot eliminate the contact of a part of the glass piece with the spacer which can cause the appearance of rough spots and scratches on the glass surface during transportation. Finally, a serious disadvantage of the method is that it cannot dispense with the use of a spacer material altogether even if the use of such material is minimized owing to the fact that the spacers are only placed at the top of the stack and at every second glass piece.

SUMMARY OF THE INVENTION

It is the main object of the invention to provide a method for packing glass in a container which eliminates the need to use a spacer material for separating glass pieces.

Another object of the invention is to provide a method for packing glass in a container which eliminates any contact both between both glass pieces and glass pieces and spacers.

Still another object of the invention is to provide for more cost-effective packing of glass in a container.

It is also an object of the invention to provide apparatus for packing and transportation of glass in a container.

An additional object of the invention is to provide conditions for mechanized loading of glass into a container according to the invention.

These and other objects are accomplished by a method for packing glass in a container which is internally provided with top and bottom guiding elements having elastic straps, consisting of forming a stack of glass in the space between the straps and restraining the stack the invention, restraining is effected by positively expanding the elastic straps by means of individual expanding systems which are provided between the guiding elements and straps, with concurrent pressing of the stack in a direction parallel with the stack plane.

The purpose is also achieved by an appratus for carrying out the method for packing glass, comprising a casing, and top and bottom guiding elements secured thereto and arranged in a mirror reflecting position with elastic straps. According to the invention, the systems for expanding the elastic straps comprise two rows of similar members which are distributed with respect to the straps and axially shifted, the upper row of the members being rigidly coupled to the straps and the lower row of the members being disposed freely on said guiding elements.

To ensure a desired amount of expansion of the elastic straps, the systems for expanding the straps preferably comprise two rows of trapesoidal members installed with their bases facing alternately upwards and downwards.

The same purpose may be accomplished by using expanding systems comprising two rows of hexagonal members.

The expanding systems may also comprise cylindrical members.

Members of an elliptical shape may also be used for forming expanding systems.

In another embodiment, the method may be carried out by an apparatus having the expanding systems made in the form of pivotally interconnected links having their upper pivots coupled by means of brackets to abutments secured to the elastic straps and lower pivots provided with rollers suppoted by the guides for movement therealong.

The invention substantially consists in the following.

When a stack of glass pieces is placed on shock-absorbers having elastic straps which are disposed on the bottom of a container, with concurrent compression of the stack by means of similar shock-absorbers placed over the glass pieces, the elastic straps are positively caused to expand by means of individual systems for expanding the elastic straps. The individual systems for expanding the elastic straps are disposed between the guiding elements and the straps so as to act positively on the elastic material of the straps, e.g. rubber and to cause a controllable elongation of the straps. During the expansion of the straps the stack of glass pieces, which was originally formed as an integral body, is transformed into a pack of glass pieces in which individual glass sheets are separated from each other by air spaces. Therefore, the glass pieces are restrained in this case owing to a positive expansion of the elastic straps under the action of individual expanding systems and also owing to a concurrent pressing of the glass stack in the direction of the edges, that is in parallel with the stack plane.

The individual expanding systems are made in the form of two rows of similar members of an appropriate shape which are shifted, the upper row being rigidly coupled to the strap and the lower disposed freely on the guiding element. When the glass weight and the pressing force act on such an expanding system, the two-row pattern of the similar members is converted into a single-row pattern, which is accompanied by a certain elongation of the whole system owing to the interaction of the members. Since a part of the members are rigidly coupled to the strap, the strap is immediately expanded (elongated) upon conversion of the two-row system into the single-row system, and at the same time the glass pieces are caused to re-arrange with air spaces therebetween. Consequently the expansion of the strap occurs owing to the provision of the members of a exactly predetermined shape which, upon a displacement of one row of the members e.g. of the upper row, downwards causes a concurrent lateral displacement of the members re-arranged into the single-row configuration. Accordingly, the expanding systems may comprise two rows of members of trapezoidal, hexagonal, cylindrical, and elliptical shape. The above-mentioned configurations of the members forming the systems for expanding the straps ensure an elongation of the entire system as a whole when they are arranged in two rows of which one (upper) row is rigidly coupled to the straps and the other (lower) row is disposed freely on the guiding element and when their side surfaces cooperate with each other.

The system for expanding the elastic strap may also comprise pivotally interconnected links, the upper parts of the links being rigidly coupled to the strap and the lower parts of the links being installed on the guide for movement therealong. When the weight of a glass stack and the pressing force act on such a system, the links are aligned in the horizontal plane or, in other words, the initial angle between adjacent links increases. Since the upper part of the links is rigidly coupled to the strap, such conversion of the system causes the elongation of the system as a whole resulting in a respective elongation of the strap.

It will be apparent from the above that the substance of the method resides in providing a positive expansion of the elastic straps engaging the glass edges, by means of individual expanding systems acting on the straps and causing their elongation, and the construction of an apparatus for carrying out the method is determined by the use of the expanding systems either in the form of two rows of similar members of which the upper member is rigidly coupled to the strap and the lower member is disposed freely on the guiding element, or in the form of pivotally interconnected links, the upper part of the links being rigidly coupled to the strap and the lower part installed on the guiding element for movement therealong.

As a result, a highly economically effective method for packing glass in a container designed for its transportation and storage is provided.

The formation of air spaces between glass sheets completely eliminates the need of using a spacer material and ensures the desired safety of the glass. This facility permits the glass to engage the container equipment only along the end faces of the stack; the glass surface cannot come in contact with other materials, e.g. during transportation. This eliminates the possibility of formation of rough spots and scratches on the glass. Bearing in mind high reliability of restraining glass by the method, which is provided with the arrangement of systems for expanding elastic straps exhibiting an increased rigidity in the vertical plane, the advantages of glass packing with the formation of air spaces between individual sheets as regards the elimination of glass breakage will become apparent. Tests of an experimental container made in accordance with said method showed an improved reliability of glass restraint under continuous mechanical actions on the container during transportation, and also the complete absence of glass displacements both in vertical and horizontal planes. With the reliable glass restraint by means of shock-absorbers having individual expanding systems and with a rather strong action on the stack from the top owing to the pressing of the stack, no wear of the rubber straps occurred. Not only there was no cutting through of the rubber by the glass edges pressed into the rubber, which was due to the cushioning capacity thereof, but the glass edges were additionally restrained in the rubber thus preventing them from performing even minor displacements during transportation.

The method for packing glass in a container is simple in its embodiment. In addition, the method is versatile as it is equally suitable for packing, transportation and storage of both flat and bent glass sheets. The concept of the method proves applicable to practically all existing glass containers after their minor modifications and also to any new containers. The formation of minimum spaces between glass sheets results in an improved cost effectiveness of their transportation as the useful area of the container is utilized more completely with such packing of the glass.

BRIEF DESCRIPTION OF THE DRAWINGS

The invention will be better understood from the following detailed description of specific embodiments when read in conjunction with the accompanying drawings, in which.

DETAILED DESCRIPTION OF THE INVENTION

Figure 1:
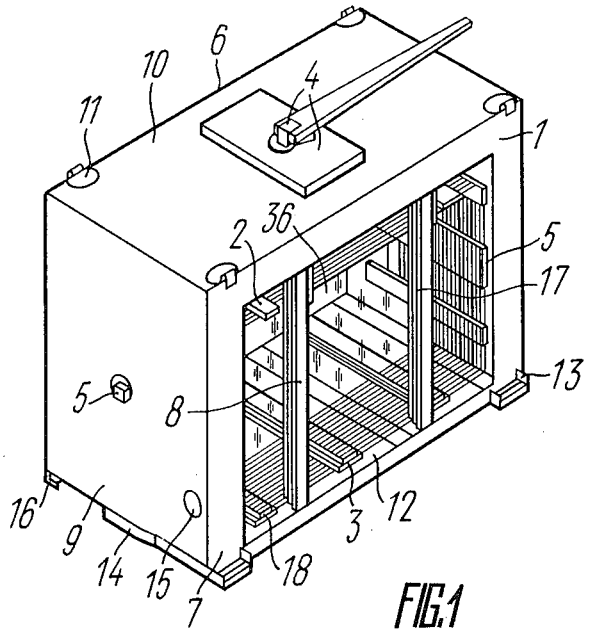
FIG. 1 is a perspective view of an apparatus for packing glass in a container.
Figure 2:
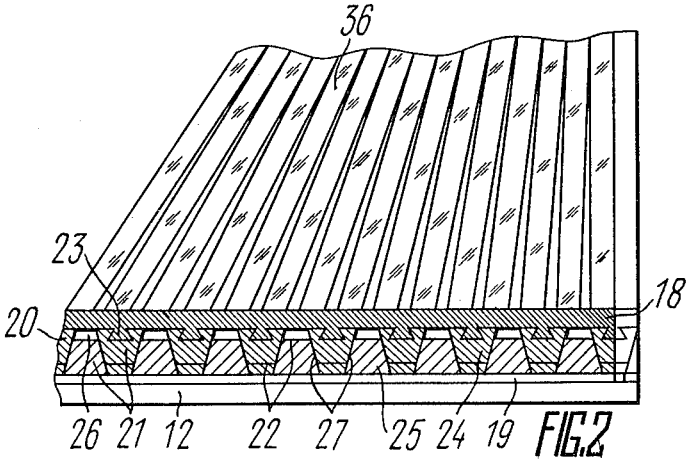
FIG. 2 is a longitudinal section of one of the shock-absorbers having members of trapezoidal shape.

Apparatus shown in the drawings (FIGS. 1 through 5) comprise a casing 1 having upper shock absorbers 2 and lower shock-absorbers 3, a pressing mechanism 4, and lateral retainers 5.

The casing 1 has an open front wall 6, a rear wall 7 in the form of cross-bars 8, and metal side walls 9 in which the lateral retainers 5 are secured. A top wall 10 is designed for securing the pressing mechanism 4 thereto and it has rings 11 for slinging and tilting the container. The lower shock-absorbers 3 are secured to a bottom wall 12 of the container to which are also secured hinged rear legs 13 each having an arm 14 and an arm retainer 15. Front legs 16 of the container comprise channel bars having openings for inserting forks of a fork-truck (not shown in the drawings). The vertical cross-bars 8 of the rear wall 7 of the container are internally lined with a shock-absorbing material 17 such as rubber.

The upper shock-absorbers 2 are secured to the pressing mechanism 4 of a conventional type. They are installed in a mirror reflecting position to the lower shock-absorbers 3. Each shock-absorber 2 and 3 comprises an elastic, e.g. rubber, strap 18 and a guiding element 19 between which is provided an expanding system which may comprise two rows of trapezoidal members 21 installed in the guiding element 19. The members 21 are installed with their bases 22 facing alternately upwards and downwards, the members having their bases 22 facing upwards being secured, e.g. by a dovetail joint, to the strap 18. Therefore, when in the unloaded condition, the expanding system 20 comprises two rows of members of similar configuration of which an upper row 24 is secured to the strap 18 and the lower row 25 is installed in a shifted position thereto so that a space 26 is formed between the row 25 of the members installed on the guiding element 19 and the strap 18. The peripheral surfaces 27 of the members 21 are made for their movement over each other both downwards and into the initial position, the return back to the initial position being enabled by the elasticity of the strap 18.

Figure 6:
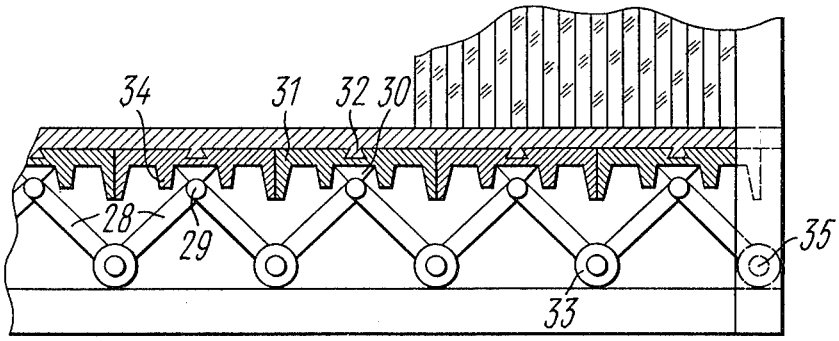
FIG. 6 is a longitudinal section of a shock-absorber having an expanding system in the form of pivotally interconnected links, shown in the unloaded condition.
Figure 7:
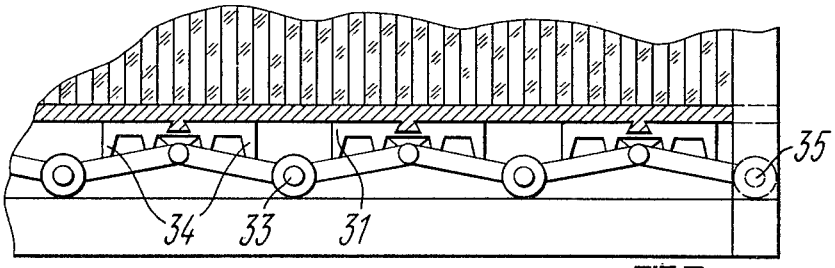
FIG. 7 is a view similar to FIG. 6 but shown in the loaded condition.

The system 20 for expanding the elastic straps 18 in another embodiment may be made in the form of pivotally interconnected links 28 (FIGS. 6 through 7) which are provided between the elastic strap 18 and the guiding element 19. At the top these members comprise pivot joints 29 which are secured in brackets 30 of abutments 31 installed on the lower side of the elastic strap 18. The abutments 31 are secured by means of joints, e.g. in the form of dovetail joints 32 to the strap 18. At the bottom the links have rollers 33 which are supported by the guiding element 19. The abutments 31 also have stops 34 for limiting the stroke of the pivotally interconnected links. A stop roller 35 of the multiple link expanding system is fixed to the guiding element 19.

Figure 3:
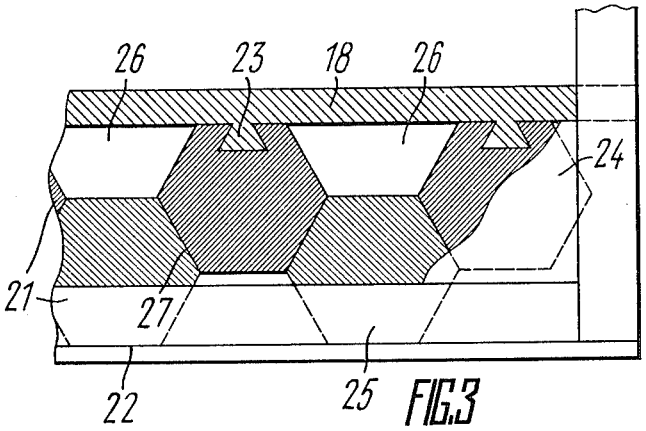
FIG. 3 is a longitudinal section, showing shock absorbers; with hexagonal members.
Figure 4:
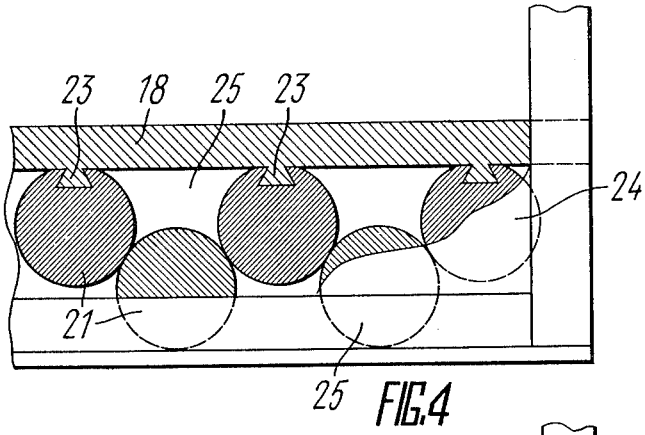
FIG. 4 is a longitudinal section, showing shock absorbers with cylindrical members.
Figure 5:
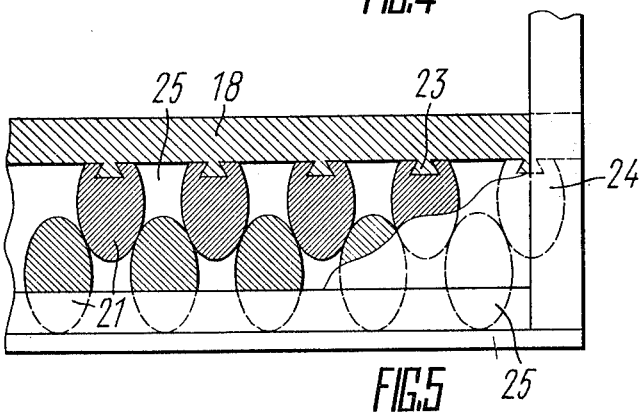
FIG. 5 is a longitudinal section, showing shock absorbers with elliptical members.

In other embodiments the expanding system 20 may comprise two rows of hexagonal, cylindrical, and elliptical members as shown in FIGS. 3–5.

The number of the upper and lower shock-absorbers 2 and 3 depends on the weight of a glass stack loaded into the container. With an increase in the stack weight the number of lower shock-absorbers 3 may be increased to three or four, and two upper shock-absorbers are enough in such case. The upper shock-absorbers 2 are installed on the pressing mechanism 4 which effects pressing of the stack downwards. The pressing mechanism may be of various types including known components and assemblies, but in any case it should ensure uniform distribution of load both over shock-absorbers and over the glass stack.

The lateral retainers 5 are also of a conventional type and consist of known components and assemblies. The lateral retainers may be made in the form of shock-absorbers, but in such case they should have individual pressing mechanisms.

The above-described apparatus functions in the following manner.

Before loading glass into a container, the container is installed in an inclined position. This operation is aimed at imparting to the glass a certain inclination in the vertical plane, so that each sheet is successively placed on the shock-absorbing material 17 of the cross-bars 8 of the rear wall 7 of the container while at the same time retaining its perpendicular position with respect to the bottom wall 12 of the container. The inclined position of the container also prevents the glass sheets from accidentally falling out during the formation of the stack 36 of material. The stack 36 is formed by feeding individual glass sheets in a sequence into a space formed between the shock absorbers 2 and 3. The upper shock-absorbers 2 should be lifted by the pressing mechanism 4 to the upmost position. The glass sheets are installed on the lower shock-absorbers 3, mechanized feeding of the glass to the container, e.g. by means of a conventional feeder, being most preferable. When the glass is fed onto the lower shock-absorbers 3, it is installed with its end faces on the rubber strap 18. In the unloaded condition, the strap 18 is slightly expanded so that the members 21, e.g. of trapezoidal configuration, which are rigidly coupled thereto by means of the joints 23, are offset upwards. Therefore, the glass is fed, during the formation of the stack, to the shock-absorbers 3 having the straps 18 and their expanding system 20 which consists of two rows of the members 21 of similar shape which are arranged with shift in the guiding element 19. The space 26 is formed between the row 25 of the members 21 which are disposed on the guiding element 19 and the strap 18. Bearing in mind that the members 21 are installed with their bases 22 facing alternately upwards and downwards, it will be apparent that the system 20 for expanding the straps 18 represents a structure which is capable of moving both downwards and laterally. It is this process that occurs upon complete loading of the container with glass and subsequent pressing of the stack 36 downwards. Thus, the members 21 of the upper row 24 start moving down along the guiding element 19. Since the members 21 are installed with their bases 22 facing alternately upward and downward, the remaining members move laterally apart concurrently with the movement of the row 24. This movement apart causes an expansion of the strap 18 owing to the rigid coupling between the strap 18 and the members 21. The end faces of the glass pieces fixed under their own weight and rubber elasticity start moving apart, and air spaces separating them are formed therebetween.

The above-described processes occur when the glass stack 36 is pressed down. At the same time, similar processes occur also with the upper shock-absorbers which are installed in the mirror reflecting position to the lower ones. Bearing in mind the similarity of the members 21 making up the expanding systems 20 of both upper shock-absorbers 2 and lower shock-absorbers 3, that is their absolutely identical dimensions and shape, it will be apparent that the expansion of the elastic straps 18 of the upper shock-absorbers 2 occurs concurrently with the formation of the air spaces at the bottom of the stack, that is just the same spaces are formed at the top of the stack. Therefore, the glass stack is arranged in space between the elastic straps 18 with spaces between glass sheets. Bearing in mind the rigidity of the expanding system 20, especially in the vertical plane, the formation of the air spaces between individual glass sheets automatically results in restraining the whole stack in the vertical plane.

Restraining the stack in the horizontal plane to prevent it from displacing toward the side walls 9 of the container is effected by means of the lateral retainers 5 of a conventional type. After this operation is completed, the glass stack is completely restrained, and the container is ready for placing it into the initial position, that is in the vertical position. It should be noted that with such loading of glass into the container the guiding elements 19 of the shock-absorbers 2 and 3 on the side of the rear wall 7 may be provided with stops (not shown in the drawings) for limiting the stroke of the members 21 of the expanding system 20. In such case the expansion of the straps 18 is of a predetermined glass-loading oriented nature since the expanding systems 20 of the shock-absorbers 2 and 3 can only move apart in one direction, namely towards the open front end of the container.

It will be apparent that the degree of expansion of the strap 18 depends on the weight of the glass stack, natural elasticity and dimensions of the members 21 of the expanding system 20, and friction forces acting during the movement of the members 21 downwards between the peripheral surfaces 27 and during the movement of the members 21 laterally along the guiding element 19. Depending on the above-mentioned parameters, three cases of expansion of the strap 18 during loading of the glass or formation of the stack on the lower shock-absorbers 3 may occur.

It has been found during the tests of the container that the expansion of the straps 18 of the lower shock-absorbers 3 may occur immediately upon installation of the glass pieces thereon, and a partial expansion of the straps 18 is possible, or there may not be such expansion at all during formation of the stack. These options are explained by the fact that properties of the strap made of rubber may vary and depend completely on its dimensions, and first of all on its thickness. The strap width is equal to the length of the members 21. In case the elasticity of the strap, taken together with the friction forces in the expanding system 20, exceeds the stack weight, there will be no expansion during formation of the stack, or such expansion will be minimum or partial, but in any case not final in case they are about equal, the expansion occurring immediately upon placing the glass into the container only if these forces are smaller than the stack weight. In the latter case the air spaces between glass sheets are formed immediately upon placing the glass sheets on the lower shock-absorbers 3, and the upper shock-absorbers 2 or the pressing of the stack are used for adjusting the stack by forming similar spaces at the top. With a partial expansion of the strap 18 minimum spaces between glass sheets are formed at the bottom of the stack, and these spaces are enlarged by pressing the stack downwards. The pressing causes the row 24 of the members 21 to come in touch with the guiding element 19, that is the rows of oppositely installed members of similar congruent shape are aligned up to the complete expansion of the strap 18.

In case there is no expansion at all during formation of the stack, such expansion is achieved just the same only by pressing by means of the pressing mechanism 4. Bearing in mind that the elongation of the strap in any case occurs owing to the provision of the expanding system 20 which reacts differently on the external conditions—the stack weight in this case, it will be apparent that such elongation is artificial or compulsory.

The expansion of the strap 18 enabling the formation of spaces between 1 and 1.5 mm between glass sheets is the most preferred. The degree of expansion of the straps 18 in choosing its thickness depends on dimensions of the members 21 making up the expanding system, and, in particular, on the difference between dimensions of the upper part of the trapezoidal members and their bases.

Apart from being trapezoidal, the members 21 may be of various configurations. It should be, however, kept in mind that the trapezoidal shape of the members 21 is the most preferred as it provides for minimum friction between the adjacent members in movement and also contributes to uniform distribution of load represented by the glass stack weight and pressing force over the guiding element 19.

In other embodiments the expanding system 20 may consist of hexagonal, cylindrical, and elliptical members. It should be, however, noted that with any such embodiment of the expanding system substantial friction forces develop between adjacent members of the system, and there is evidently non-uniform distribution of load over the guiding element.

The members 21 of the expanding system 20 may be made of wood, plastic, and metal. The criteria for selecting the material for making the members 21 should be their small weight and absence of substantial friction when they are in contact with each other.

The number of shock-absorbers 2 and 3 depends on the size of loaded glass pieces, the embodiment "two at the top and two at the bottom" being the most preferred. For transportation of large-size glass pieces in big packs the number of the lower shock-absorbers 3 may be increased.

In a further embodiment, the expanding system is made in the form of pivotally interconnected links 28 which are also installed between the elastic strap 18 and the guiding element 19. In this case, when the glass is installed on the lower shock-absorbers 3, the strap 18 may expand immediately during formation of the stack, but it may also expand partly or remain unchanged. The complete expansion of the strap in the two latter cases is achieved by pressing the stack downwards. At any rate, the expansion of the strap is obtained owing to the straightening of the system of the pivotally interconnected links 28 which are at an angle of about 90° to each other in the initial position (in the underloaded condition). The load provided by the weight of the glass stack and by the pressing mechanism 4 is re-distributed between the links 28 by means of the stops 31 secured by means of the joints 32 to the lower side of the strap 18, brackets 30, and pivotal joints 29, so as to straighten the position of the links. The rollers 33 which are supported by the guiding element 19 start moving horizontally to expand the links. This movement continues until the links 28 come in touch with their stroke limiters 34 which engage the links to stop their straightening. Since the abutments 31 are rigidly coupled to the strap 18, the straightening of the links 28 causes the expansion of the strap. The glass sheets are thus separated by air spaces, the size of the air spaces depending on the dimensions of the links 28 and length of the stroke limiters 34.

Since the upper shock-absorbers 2 in this embodiment are installed in mirror reflecting position to the lower ones, similarly to the above-described embodiments, their operation does not differ greatly from that of the shock-absorbers 3, with the only difference that here the expanding systems 20 function only under the action of the force developed by the pressing mechanism 4.

After the vertical restraining of the stack by means of the shock-absorbers 2 and 3, the stack is restrained horizontally by means of the lateral retainers 5.

It will be apparent from the above description that the method for packing glass sheets in a container and the apparatus for carrying out this method have the following advantages:

The method does not require the use of special materials for providing spaces between individual glass sheets. Rubber which is used for the elastic straps is in this case part of the equipment, and the consumption of rubber is small. In addition, the method does not exclude the use of other materials with an appropriate elasticity to replace rubber.

The method described above is simple in its implementation so that it may be quickly introduced in the glass-making industry.

The method is versatile as it is suitable for packing, transportation and storage of both flat and bent glass. In addition, the concept of the method proves applicable to both existing containers, crates, and racks and new containers.

The concept of the method determines an improved reliability of the formation of air spaces between glass sheets in a stack owing to the positive expansion of elastic straps. The absence of contact between the glass sheets and the strap, in combination with reliable restraint of the glass by means of the shock-absorbers, results in a substantial reduction of glass losses through breakage during transportation. The provision of a sufficient rigidity of the shock-absorbers, in combination with the provision of an elastic strap, makes it possible to place glass under conditions where there is no contact between the sheet surface and the spacer material, thus not only eliminating breakage of the glass but even minor deterioration of surface quality.

The method eliminates glass losses through leaching when transported without air spaces between sheets, which is very important, especially taking into account the shortage of spacer materials, and first of all, paper.

The method makes it possible to dispense with the conventional packing of glass at an angle to the vertical plane. The packing of glass in the position perpendicular to the bottom wall of the container ensures the most complete utilization of the useful area of the container thus improving the cost-effectiveness of transportation. In addition, this advantage makes it possible to dispense with the conventional pyramid-type containers with oblique walls. The use of rectangular containers substantially improves the cost-effectiveness of glass transportation by all types of transports, especially by automobile, railway and water transports.

Owing to the possibility of placing the container in an inclined position, the method enables mechanized glass loading into the container.

The design of the above-described apparatus makes it possible to provide containers of larger capacity.

What is claimed is:

1. A method for packing glass sheets in a container having upper and lower guides provided with elastic straps, comprising the steps of forming a glass stack in the space between the elastic straps; subsequently restraining said glass stack with air gaps between adjacent stacks in a plane perpendicular to said elastic straps by positively expanding the elastic straps; and concurrently pressing the glass stack in a direction parallel with the plane of said glass stack.

2. An apparatus for packing glass sheets comprising: a casing; top and bottom guiding elements having elastic straps, secured to said casing and installed in a mirror reflecting position thereto; and individual systems expanding said elastic straps and consisting of two rows of members dispersed with respect to the straps and axially offset, members of an upper row being rigidly coupled to said straps and members of a lower row being disposed freely on said guiding elements.

3. An apparatus according to claim 2, wherein the systems for expanding the elastic straps comprise two rows of trapezoidal members which are installed with their bases facing alternately upward and downward.

4. An apparatus according to claim 2, wherein the systems for expanding the elastic straps comprise two rows of hexagonal members.

5. An apparatus according to claim 2, wherein the systems for expanding the elastic straps comprise two rows of cylindrical members.

6. An apparatus according to claim 2, wherein the systems for expanding the elastic straps comprise two rows of elliptical members.

7. An apparatus for packing glass sheets, comprising: a casing; top and bottom guiding elements having elastic straps, secured to said casing and installed in a mirror relationship thereto; and individual systems expanding said elastic straps and consisting of pivotally interconnected links having upper and lower pivots, abutments secured to said elastic straps, brackets by means of which the upper pivots of the pivotally interconnected links are coupled to said abutments, and rollers supported by said guides for movement therealong, the rollers being coupled to the lower pivots of the pivotally interconnected links.

* * * * *